US009140077B2

(12) United States Patent
Cupolillo et al.

(10) Patent No.: US 9,140,077 B2
(45) Date of Patent: Sep. 22, 2015

(54) THERMAL INSULATION FOR PIPES IN A DRILL PIPE RISER, TUBULAR SEGMENT AND THERMAL INSULATION SYSTEM FOR JOINT COUPLINGS

(75) Inventors: Gilmar Souza Cupolillo, Ilha Do Governador (BR); Renato Cesar Martins Vieira, Rio de Janeiro (BR)

(73) Assignee: IPB-GR Indústria Mecânica Ltda., Rio das Ostras, Rio de Janeiro (BR)

( * ) Notice: Subject to any disclaimer, the term of this patent is extended or adjusted under 35 U.S.C. 154(b) by 516 days.

(21) Appl. No.: 13/423,445

(22) Filed: Mar. 19, 2012

(65) Prior Publication Data

US 2012/0241165 A1 Sep. 27, 2012

(30) Foreign Application Priority Data

Mar. 21, 2011 (BR) ..... 1101090

(51) Int. Cl.

| | |
|---|---|
| ***E21B 7/12*** | (2006.01) |
| ***E21B 17/01*** | (2006.01) |
| ***E21B 17/02*** | (2006.01) |
| ***E21B 36/00*** | (2006.01) |

(52) U.S. Cl.

CPC ..... *E21B 17/01* (2013.01); *E21B 17/012* (2013.01); *E21B 17/02* (2013.01); *E21B 36/003* (2013.01)

(58) Field of Classification Search

CPC ..... E21B 17/01
USPC ..... 166/350, 367, 302; 138/149; 285/145.1, 285/47, 145.4, 302
See application file for complete search history.

(56) References Cited

U.S. PATENT DOCUMENTS

| | | | | |
|---|---|---|---|---|
| 3,801,140 | A * | 4/1974 | Keller | 285/47 |
| 4,084,842 | A * | 4/1978 | Stonitsch et al. | 285/47 |
| 5,996,643 | A * | 12/1999 | Stonitsch | 138/143 |
| 6,049,657 | A * | 4/2000 | Sumner | 392/469 |
| 6,079,452 | A * | 6/2000 | Touzel et al. | 138/149 |
| 6,739,803 | B2 * | 5/2004 | Bass et al. | 405/169 |
| 6,814,146 | B2 * | 11/2004 | Bass et al. | 166/302 |
| 6,926,040 | B1 * | 8/2005 | Prescott et al. | 138/148 |
| 2005/0117974 | A1 * | 6/2005 | Karayaka et al. | 405/211 |
| 2006/0131027 | A1 | 6/2006 | Chiesa et al. | |

* cited by examiner

*Primary Examiner* — Matthew Buck
*Assistant Examiner* — Aaron Lembo
(74) *Attorney, Agent, or Firm* — Winstead PC

(57) ABSTRACT

A thermal insulation of pipes of a drill pipe riser, the novelty consisting basically in the fact that the thermal insulation comprises several layers around the pipe and between the first layer and the pipe, and between two adjacent layers, there are spaces where sea water penetrates. A thermal insulation system of joint couplings of pipes for a drill pipe riser comprising a tubular segment that circumferentially surrounds the region of the joint coupling and, so that between the tubular segment and the pipes is formed a space where sea water penetrates.

19 Claims, 5 Drawing Sheets

THERMAL INSULATION FOR PIPES IN A DRILL PIPE RISER, TUBULAR SEGMENT AND THERMAL INSULATION SYSTEM FOR JOINT COUPLINGS

BACKGROUND OF THE INVENTION

1. Technical Field

This invention consists of thermal insulation for pipes of steel of a drill pipe riser, also denominated as DPR, for the exploitation of petroleum in subsea wells.

2. History of Related Art

As it is generally known, a drill pipe riser is made up of several lengths of pipes threaded together at their respective ends, to be used to drill an oil well, as well as for long-term production test of wells (lasting five to nine months) in order to measure the flowrate of that well or if the well is economically viable. The long-term production test also allows the pre-production of the well.

After the conclusion of the tests, the drill pipe riser is removed and the final flexible pipe risers are installed.

The pipes of the drill pipe riser are made of steel and, considering the low temperatures at great depths, said pipes must be thermally insulated, in order to prevent heat transfer from the petroleum to the seawater during its passage from the sea bottom to the surface. If there is no thermal insulation, the petroleum becomes very viscous substantially reducing its flow rate.

SHORTCOMINGS OF THE PRIOR ART TECHNIQUE

The thermal insulation of the prior art technique for the drill pipe riser is applied to the pipes of the column by means of a hot thermoplastic wrapping, in a spiral manner, on each pipe of the drill pipe riser or by means of a spray gun.

One of the inconvenient aspects of insulations from the prior art technique is that the thermoplastic is applied in such a way to the pipe that water cannot pass between the pipe and the internal surface of the thermoplastic. Thus, due to the high subsea pressures to which the insulation is subject, the entry of water is forced between the insulation and the joint, forming a type of water pocket under pressure. Thus, when the drill pipe riser is raised to the surface, a phenomenon known as a "bursts" (embolism)," in other words, the water contained under pressure in the pocket, breaks through the insulation in many places.

Another shortcoming of the prior art thermal insulation is the fact that the insulation of the joint coupling of two pipes is done using two half chutes which are bound to each other by several straps. This insulation takes a long time and is complicated, resulting in considerably higher costs and, frequently as well, the "bursting" phenomenon occurs, damaging the insulation.

SUMMARY OF THE INVENTION

The objectives of the present invention are the production of a thermal insulation for a drill pipe riser that avoids this "bursting" phenomenon and that substantially reduces the costs of insulation and installation of the riser.

This objective is achieved by a thermal insulation of the pipes of the drill pipe riser for subsea petroleum production, wherein it includes at least one layer of thermal insulation applied around a pipe, so that between the pipe and the thermal insulation there is a space where sea water penetrates. The objective is also achieved by a thermal insulation which comprises several layers of thermal insulation applied around a pipe, so that between the first layer and the pipe and between each two adjacent layers there are spaces where sea water penetrates.

Thus, one of the advantages of the thermal insulation according to the invention is the fact that the spaces allow the penetration of water when the pipe is under water and the drainage of water as the drill pipe riser is hoisted to the surface. In this manner, bursting and consequent damage to the insulation is avoided.

Another advantage of the invention is that the water that penetrates into these spaces forms an insulating film that increases the efficacy of the thermal insulation even more.

The objective of the invention is also achieved by means of a thermal insulation system for joint couplings of a drill pipe riser for subsea petroleum production, comprising a tubular segment that circumferentially envelops the region of the joint coupling of a first pipe with a second pipe of a thermally insulated drill pipe riser, and extends, preferably, beyond the ends of the thermal insulation of said pipes, wherein between said tubular segment and the pipes there is a space where sea water penetrates and wherein a course stop keeps the tubular segment in its position, and wherein the tubular segment is vertically displaceable, in a telescopic manner, from the first pipe, located vertically above the second pipe, until it is located in the region of the joint coupling, and wherein the course stop limits the displacement of the tubular segment.

Thus, one other advantage of the invention is the fact that the thermal insulation of the joint coupling of two pipes avoids "bursting" and is done much more quickly, substantially reducing installation costs.

BRIEF DESCRIPTION OF THE DRAWINGS

The invention will be described in more detail below, based on the attached figures, as examples.

DETAILED DESCRIPTION OF ILLUSTRATIVE EMBODIMENTS OF THE INVENTION

Embodiment(s) of the invention will now be described more fully with reference to the accompanying Drawings. The invention may, however, be embodied in many different forms and should not be construed as limited to the embodiment(s) set forth herein. The invention should only be considered limited by the claims as they now exist and the equivalents thereof.

Figure 1:
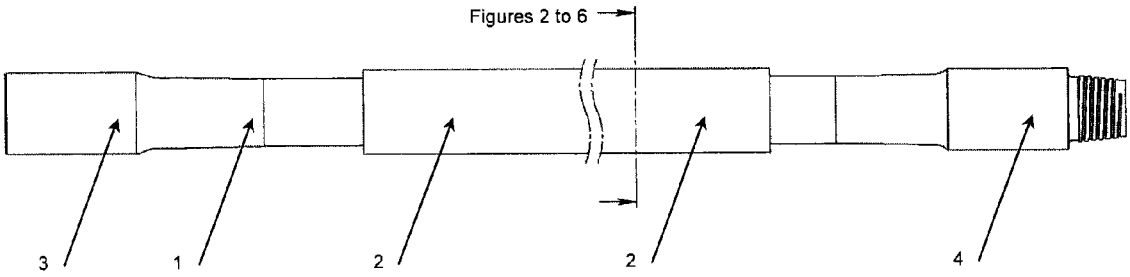
FIG. 1—view of a pipe that has been thermally insulated according to the invention.

FIG. 1 shows a pipe 1 of a drill pipe riser (DPR) with the thermal insulation 2 according to the invention. One can see in the figure, the first end 3 (the female end) with an internal thread, and the second end 4 (the male end) with an external thread.

Figure 2:
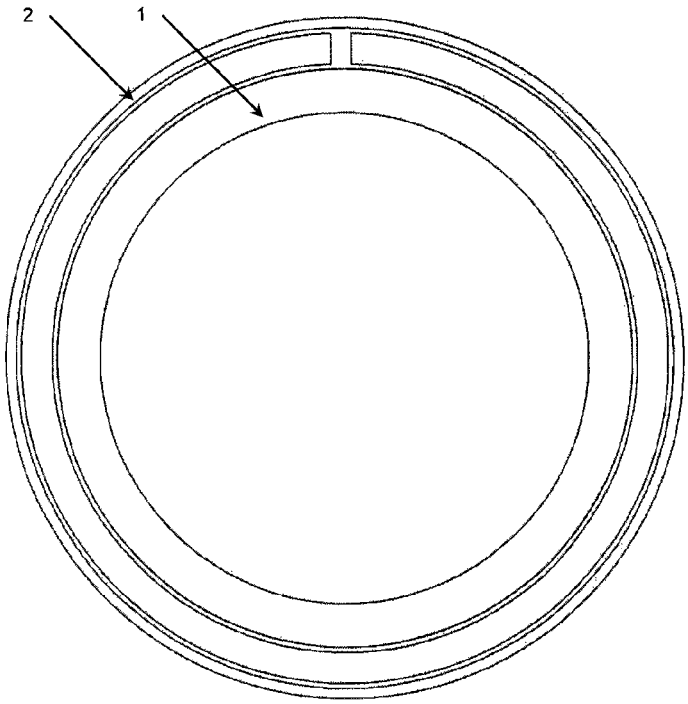
FIG. 2—cross section view of pipe of FIG. 1, showing the preferred embodiment of the thermal insulation in accordance with the invention.

FIG. 2 is sectional view of the pipe of FIG. 1, showing the preferred embodiment of the thermal insulation 2 according to the invention.

Figure 3:
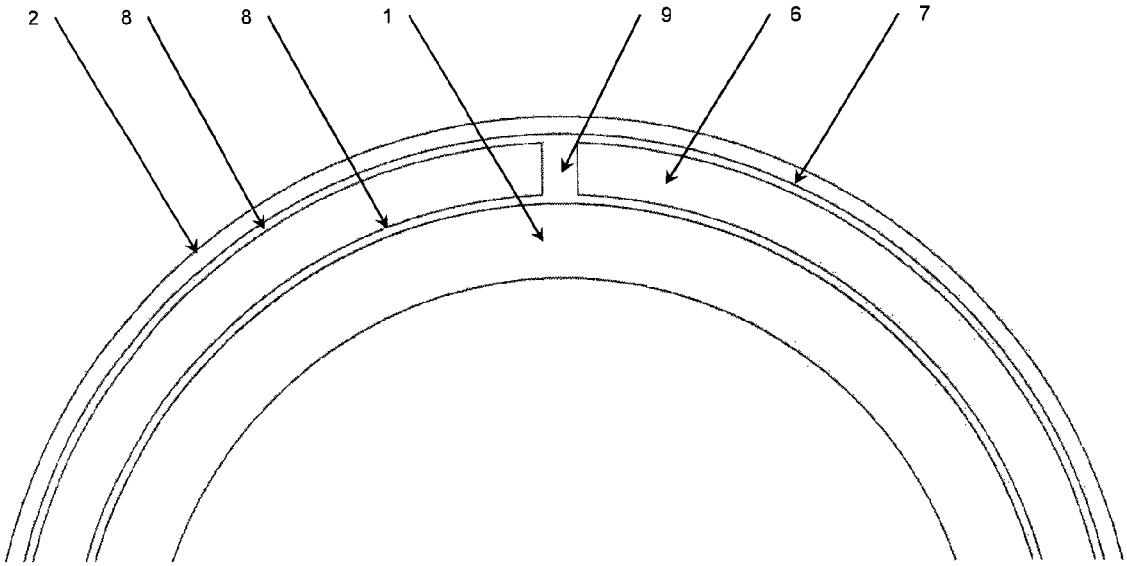
FIG. 3—enlarged view of the cross section of FIG. 2.

FIG. 3 shows in more details the thermal insulation 2 of FIG. 2, which comprises two layers of thermal insulation 6 and 7 disposes around the pipe 1, wherein between the first layer 6 and the pipe 1, and between the first layer 6 and the second layer 7, there are spaces 8 where the sea water penetrates. These spaces avoid the shortcoming of the bursting and extend, preferably, around the circumference of the pipe 1 and along the entire length of the thermal insulation 2. Preferably, all spaces where the sea water penetrates, communicate with each other.

The first layer 6 has a longitudinal groove 9 along its entire thickness and length, which facilitates the placement of this layer 6 on pipe 1. The second layer 7 is complete (without groove) and both layers 6 and 7 are installed by extrusion, preferably. For example, the layers are cold laid (pushed), on one of the joint's ends, in other words, first the first layer 6 is laid, when the groove 9 is opened during its placement and, following that, the second layer 7 is laid on the first layer 6. The thermal insulation according to the invention may consist of several layers of thermal insulation.

Figure 4:
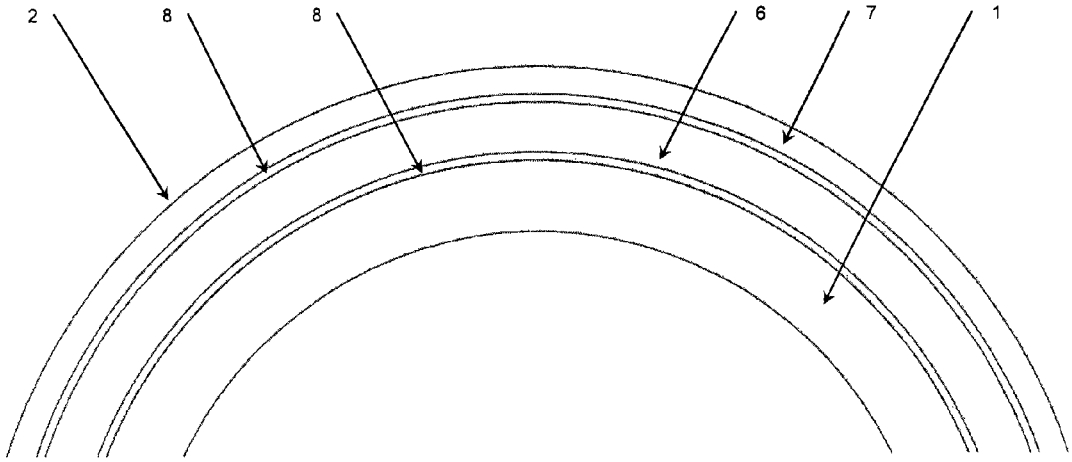
FIG. 4—cross section view of a second embodiment of the thermal insulation according to the invention.

FIG. 4 shows the second embodiment of the thermal insulation 2 according to the invention. This embodiment is similar to the one of FIG. 3, with layers 6 and 7 of thermal insulation, but in this case, the first layer 6 of thermal insulation does not have a groove and, consequently, the spaces 8, where the sea water penetrates are not interconnected.

Figure 5:
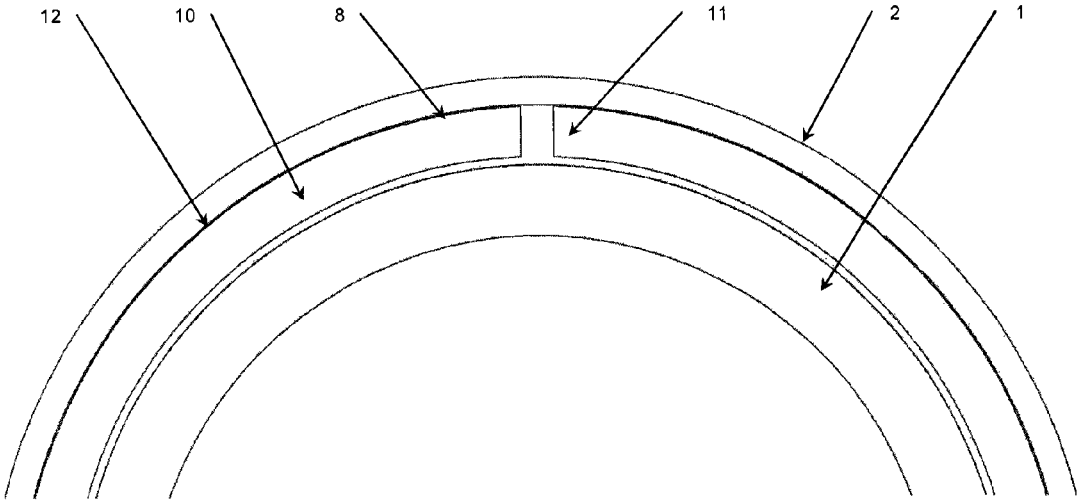
FIG. 5—cross section view of a third embodiment of the thermal insulation according to the invention.

FIG. 5 shows a third embodiment of the thermal insulation 2 according to the invention, wherein the insulation comprises a first layer of thermal insulation 10 with a longitudinal groove 11 and a second layer of thermal insulation 12, placed on the first layer 10, so that between the tube 1 and the first layer 10 of thermal insulation there is a space 8 where the sea water penetrates. The longitudinal groove 11 extends through the entire thickness and length of the first layer 10 and facilitates the placement of said layer 10 on pipe 1. The second layer 12 is complete (without groove).

Figure 6:
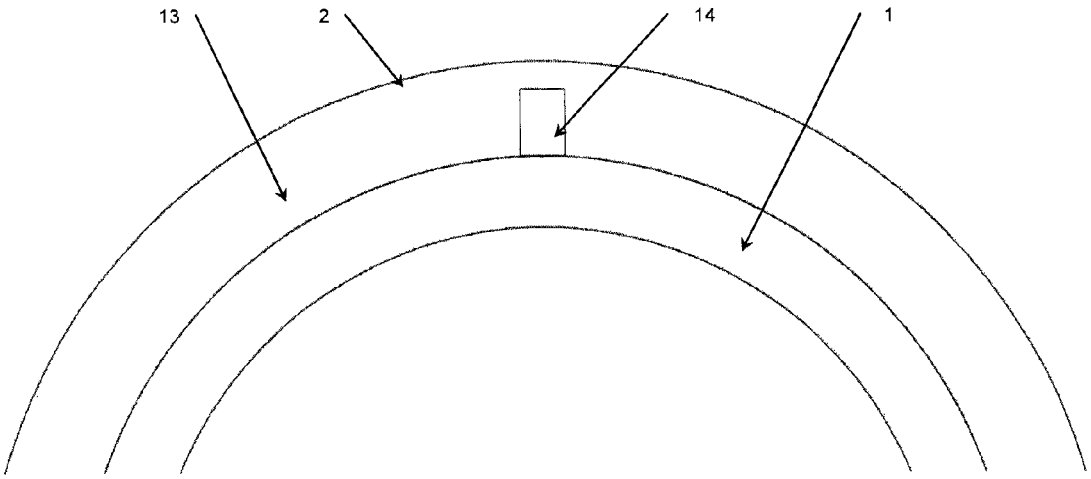
FIG. 6—cross section view of a fourth embodiment of the thermal insulation according to the invention.

FIG. 6 shows a fourth embodiment of the thermal insulation 2 according to the invention, comprising a single layer 13 of thermal insulation with a longitudinal groove 14, which partially extends through the thickness of this layer, and longitudinally extends along the entire length of the thermal insulation 2. In this embodiment, the groove 14 aids the placement of insulation 13 on pipe 1. In addition, taking into account that groove 14 has a greater width than the others shown in other embodiments, it acts as a space which simultaneously allows the sea water to penetrate and avoids the hazards of bursting.

In one other embodiment (not shown in the figures), the thermal insulation according to the invention may extend from the first end of pipe 3, the female end, to the second end of the pipe 4, the male end, completely insulating the pipe, longitudinally and around its circumference. In this case, in the regions of the end of pipe 1, where the diameter is greater, a length of insulation may be placed with an internal diameter greater than that of the rest of the pipe. With this alternative for thermal insulation of pipe 1, it is not necessary to use a tubular segment to insulate the joint coupling between the two pipes 1.

Figure 7:
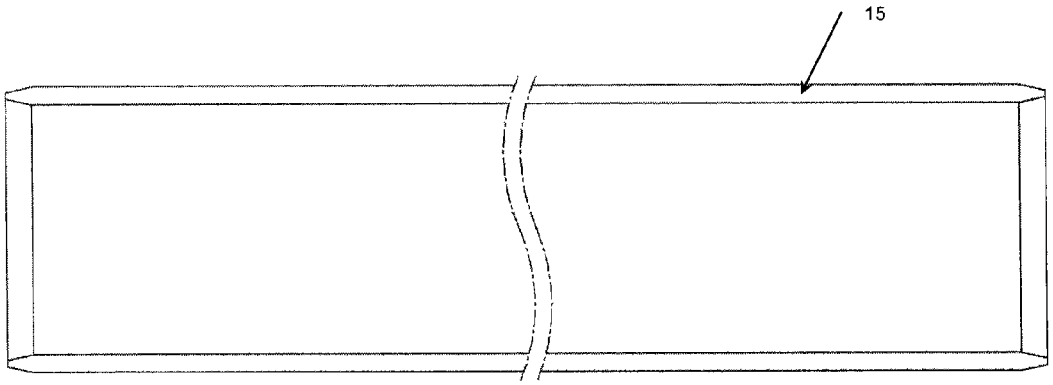
FIG. 7—longitudinal sectional view of the tubular segment according to the invention for thermal insulation of the joint couplings.

FIG. 7 shows a sectional longitudinal view of tubular segment 15 according to the invention, for the thermal insulation of joint coupling of pipes. The joint coupling between two pipes 1 has a diameter greater than the one of the remaining extension of the pipe and, thus, the tubular segment 15 is suitable to insulate the region of the joint coupling, as shown in more detail in FIG. 8.

Figure 8:
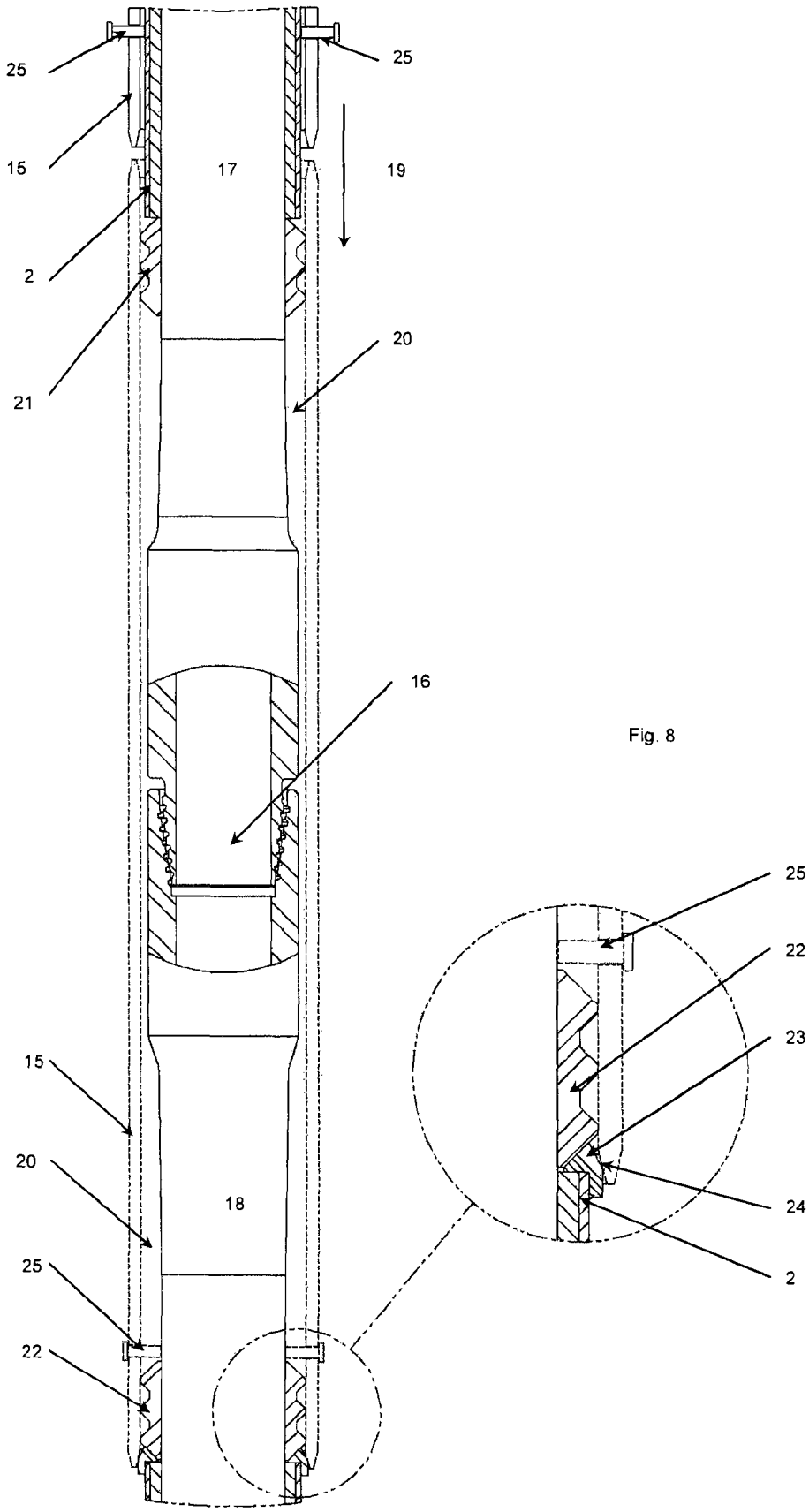
FIG. 8—view of the thermal insulation system for joint couplings, according to the invention.

FIG. 8 shows the preferred embodiment of a thermal insulation system according to the invention, for the insulation of a joint coupling of pipes.

The figure shows a joint coupling 16 between a first pipe or upper pipe 17 and a second pipe, or lower pipe 18. Both pipes have the thermal insulation 2 according to the invention. One can see in the figure that the tubular segment 15 is located in an initial position, surrounding the first pipe 17, before installation in the region of the joint coupling 16. Next, this tubular segment 15 is displaced telescopically downwards, as arrow 19 shows, until it reaches its final position enclosing joint coupling 16. In the final position, the tubular segment 15, shown in dashed lines, extends preferably beyond the ends of thermal insulations 2 of said pipes 17 and 18, and forms a space 20 with pipes 17 and 18, where water penetrates. Said space 20 avoids the occurrence of bursting, in other words, the space 20 allows the entry of sea water due to the pressure of said sea water, and allows its drainage as the drill pipe riser is hoisted to the platform.

One can also see on the figure an upper sleeve 21 and a lower sleeve 22, which are attached respectively to pipes 17 and 18, for example by means of gluing and serve to guide the tubular segment 15 when it slides down to the region of joint coupling 16. Sleeves 21 and 22 also serve to create an obstruction to the drainage of water from space 20 between tubular segment 15 and pipes 17 and 18 of the drill pipe riser. These sleeves 21 and 22 have a slight clearance in relation to the internal surface of the tubular segment 15, which allows for the entry of sea water in the space 20, but avoids a free water flow, so that the water contained in space 20 remains confined during the operation, creating a thin layer of thermal insulation and, consequently, increasing insulating capacity of the tubular segment 15.

As the drill pipe riser is hoisted to the surface of the sea, the water drains from space 20 through the clearance between the tubular segment 15 and sleeves 21 and 22, thus avoiding the bursting.

One can also see in the figure that the thermal insulation system according to the invention comprises a course stop that prevents downwards movement of tubular segment 15. In the embodiment shown in FIG. 8, the course stop includes, for example, a dead stop 23 that is part of the body of lower sleeve 22 and is located on the lower end of this sleeve. Dead stop 23 acts against an internal chamfer 24 of the tubular segment 15.

The course stop can also consist of a disk, for example, (not shown in the figures) attached to the lower pipe 18, wherein the perimeter of said disk acts as a dead stop for limiting the displacement of the tubular segment 15 in a manner similar to dead stop 23 as described above.

In another embodiment, the course stop can consist of at least one bolt 25 (shown by dashed lines in FIG. 8) which may be screwed into the wall of tubular segment 15 pressing against the thermal insulation 2 of one of the pipes. In this figure, the bolt 25 presses against the lower pipe 18.

In one other embodiment of the system according to the invention (not shown in the figures), the sleeves are not necessary. In this embodiment, the wall thickness of tubular segment 15 should be greater, so that the clearance between the thermal insulation of the pipes 17 and 18 and the internal wall of tubular segment 15 is very narrow, in order to prevent a free flow of water during the operation of the drill pipe riser. Besides this, given the narrow clearance, the thermal insulation 2 of the upper pipe 17 acts as a guide of the tubular segment 15 during its downwards displacement until the joint coupling 16.

The thermal insulation according to the invention may be composed of any insulating material that is resistant to sea water. One may use, for example, a plastic, such as polypropylene, polyethylene, polystyrene, nylon, acrylics, or even rubber.

Besides the embodiments presented above, the same inventive concept may be applied to other alternatives or possibilities for the use of the invention. For example, the invention may be used in other subsea areas regardless of salinity or maritime currents, such as, for example, in rivers, bays, lakes and canals.

Therefore, it should be understood that this invention may be interpreted in a broad manner, wherein its scope of protection is determined by the terms of the appended claims.

What is claimed is:

1. A system for thermal insulation of pipes of a drill pipe riser for subsea petroleum production, the system comprising:

a layer of thermal insulation material applied substantially or completely around an entire circumference of a drill pipe riser; and an annular space defined between the circumference of the drill pipe riser and the layer, whereby in use sea water penetrates into the annular space and wherein the sea water present in the annular space facilitates insulation of the drill pipe riser.

2. The system of claim 1, wherein the layer of thermal insulation material comprises a longitudinal gap formed through an entire thickness of the layer and along an entire length of the layer of thermal insulation material.

3. The system of claim 1, wherein the layer of thermal insulation material extends around the entire circumference of the drill pipe riser except for a single longitudinal gap extending an entire length of the layer and an entire thickness of the layer.

4. The system of claim 1, wherein the layer of thermal insulation material extends around the entire circumference of the drill piper riser.

5. The system of claim 1, wherein the layer of thermal insulation material extends around the entire circumference of the drill piper riser and comprises a longitudinal groove extending an entire length of the layer and partially through a thickness of the layer, the longitudinal groove open to the annular space between the layer and the drill pipe riser.

6. A system for thermal insulation of pipes of a drill pipe riser for subsea petroleum production, the system comprising:

an inner layer of thermal insulation material applied substantially or completely around an entire circumference of a pipe;

an inner annular space formed between the inner layer and the circumference of the pipe;

a second layer of thermal insulation material disposed about the entire circumference of the inner layer and the pipe; and a second annular space formed between the inner layer and the second layer, whereby in use water penetrates into the inner annular space and the second annular space and facilitates insulation of the pipe.

7. The system of claim 6, wherein the inner annular space and the second annular space communicate with each other.

8. The system of claim 6, wherein the inner layer extends around the entire circumference of the pipe.

9. The system of claim 2, wherein the inner layer extends around the entire circumference of the pipe and comprises a longitudinal groove extending an entire length of the inner layer and partially through a thickness of the inner layer, the longitudinal groove open to the inner annular space.

10. The system of claim 6, wherein the inner layer extends around the entire circumference of the pipe except for a single longitudinal gap extending an entire length of the inner layer and an entire thickness of the inner layer between the inner annular space and the second annular space.

11. A thermal insulation system for joint couplings of a drill pipe riser for subsea petroleum production, comprising:

a first thermal insulation disposed about a first pipe;

a second thermal insulation disposed about a second pipe, the first and second pipes connected at a joint coupling;

a tubular segment that circumferentially envelops a region of the joint coupling of a first pipe with a second pipe, and extends, beyond ends of the first and the second thermal insulation; and a space between the tubular segment and the first and second pipes, whereby in use sea water penetrates into the space.

12. The thermal insulation system according to claim 11, comprising:

an upper sleeve and a lower sleeve attached respectively to the first pipe and the second pipe; and a clearance formed between an internal surface of the tubular segment and the upper and lower sleeves, whereby sea water penetrates into the space through the clearance.

13. The thermal insulation system according to claim 11, further comprising a course stop to keep the tubular segment in position about the joint coupling, wherein the course stop comprises one of:

a dead stop that is part of the lower sleeve;

a disk attached to the second pipe, wherein an edge of the disk acts as a dead stop in order to limit displacement of the tubular segment; and a bolt that is screwable in a wall of the tubular segment and acts against one of the first and the second thermal insulation.

14. The thermal insulation system according to claim 11, further comprising a clearance between an inner surface of the tubular segment and the first pipe and the second pipe, whereby sea water penetrates into the space through the clearance.

15. The thermal insulation system according to claim 11, further comprising:

a clearance between an inner surface of the tubular segment and the first pipe and the second pipe, whereby sea water penetrates into the space through the clearance; and a sleeve positioned in the clearance whereby the sleeve restricts the flow of the sea water into and out of the space.

16. The thermal insulation system according to claim 11, wherein the first thermal insulation comprises an inner layer of thermal insulation material disposed substantially or completely around the entire circumference of the first pipe to form an inner annular space between the circumference of the first pipe and the inner layer whereby the sea water penetrates into the inner annular space from the space about the joint coupling.

17. The thermal insulation system according to claim 11, wherein the inner layer extends around the entire circumference of the pipe and comprises a longitudinal groove extending an entire length of the inner layer and partially through a thickness of the inner layer, the longitudinal groove open to the inner annular space; or the inner layer extends around the entire circumference of the pipe except for a single longitudinal gap extending the entire length of the inner layer and the entire thickness of the inner layer between the inner annular space and the second annular space.

18. The thermal insulation system according to claim 17, wherein the first thermal insulation comprises a second layer of thermal insulation material disposed about the entire circumference of the inner layer and the pipe; and a second annular space formed between the inner layer and the second layer, whereby in use sea water penetrates into the inner annular space and the second annular space and facilitates insulation of the inner pipe.

19. The thermal insulation system according to claim 18, further comprising:

a clearance between an inner surface of the tubular segment and the first pipe and the second pipe, whereby sea water penetrates into the space through the clearance; and a sleeve positioned in the clearance whereby the sleeve restricts the flow of the sea water into and out of the space.

* * * * *